US005570741A

United States Patent [19]

Brucher et al.

[11] Patent Number: 5,570,741

[45] Date of Patent: Nov. 5, 1996

[54] WATER COMPARTMENT FOR A HEAT EXCHANGER

[75] Inventors: Peter Brücher; Helmut Lachmann, both of Berlin, Germany

[73] Assignee: Deutsche Babcock-Borsig AG, Berlin, Germany

[21] Appl. No.: 571,812

[22] Filed: Dec. 13, 1995

[30] Foreign Application Priority Data

Jan. 19, 1995 [DE] Germany ..... 195 01 422.7

[51] Int. Cl.[6] ..... F28F 9/02

[52] U.S. Cl. ..... 165/134.1; 165/158; 122/512

[58] Field of Search ..... 165/134.1, 135, 165/158, DIG. 403; 122/512

[56] References Cited

U.S. PATENT DOCUMENTS

| | | | |
|---|---|---|---|
| 3,610,329 | 10/1971 | Markert et al. | 165/142 |
| 4,336,770 | 6/1982 | Kaneko et al. | 122/266 |
| 4,585,057 | 4/1986 | Marburger | 165/134.1 |
| 4,848,449 | 7/1989 | Brucher et al. | 165/160 |
| 5,246,063 | 9/1993 | Fix et al. | 165/134.1 |
| 5,472,046 | 12/1995 | Brucher et al. | 165/134.1 |

FOREIGN PATENT DOCUMENTS

| | | | |
|---|---|---|---|
| 2661244 | 10/1991 | France | 165/134.1 |

*Primary Examiner*—Allen J. Flanigan
*Attorney, Agent, or Firm*—Max Fogiel

[57] ABSTRACT

Water compartment for a heat exchanger (1) for cooling hot gases, with a jacket (5) and a thinner pipe slab (6) that rests on a thicker pipe slab (7) by way of the jacket and of anchor pipes (8), whereby the anchor pipes are accommodated in the jacket and fastened to the slab and whereby gas pipes (13) extend through the anchor pipes leaving a cylindrical space, characterized in that the gas pipes are elongated and extend beyond the thinner pipe slab, in that their elongated ends (14) are reversed outside, in that the reversed ends (15) are fastened tight to the thinner pipe slab radially remote from the anchor pipes, and in that bores (17) extend through an annular area of the thinner pipe slab between the reversed ends of the gas pipes and the anchor pipes.

4 Claims, 2 Drawing Sheets

WATER COMPARTMENT FOR A HEAT EXCHANGER

BACKGROUND OF THE INVENTION

The present invention concerns a water compartment for a heat exchanger. The heat exchanger is employed for cooling hot gases. It features the characteristics recited in the preamble to Claim.

The ends of the gas pipes in a heat exchanger known from U.S. Pat. No. 4,770,239 are welded into a thin pipe slab and form an integral part thereof. Heat stress occurs at the weld in the thin slab, especially at the gas-intake end. The stress derives from one side of the weld being in contact with the hot gas and the other with the slab and hence the coolant. The stress can lead to cracking or leaking seams in this design.

SUMMARY OF THE INVENTION

The object of the present invention is to improve a water compartment of the aforesaid genus to the extent that the heat stress between the gas pipe and the thin pipe slab will be minimal. The subsidiary claims address advantageous embodiments.

The elongated and reversed ends of the gas pipes in accordance with the present invention accommodate the heat stress by deforming resiliently. The joint with the gas pipe at the gas-intake end inside the thin slab will be extensively free of heat stress. The elongated ends of the pipe can simultaneously be cooled by the particular coolant route and hence protected from overheating. To further protect against overheating, the elongated ends in one embodiment of the present invention can be embedded in ceramic.

BRIEF DESCRIPTION OF THE DRAWINGS

One embodiment of the present invention will now be specified with reference to the accompanying drawing, wherein.

DESCRIPTION OF THE PREFERRED EMBODIMENTS

Figure 1:
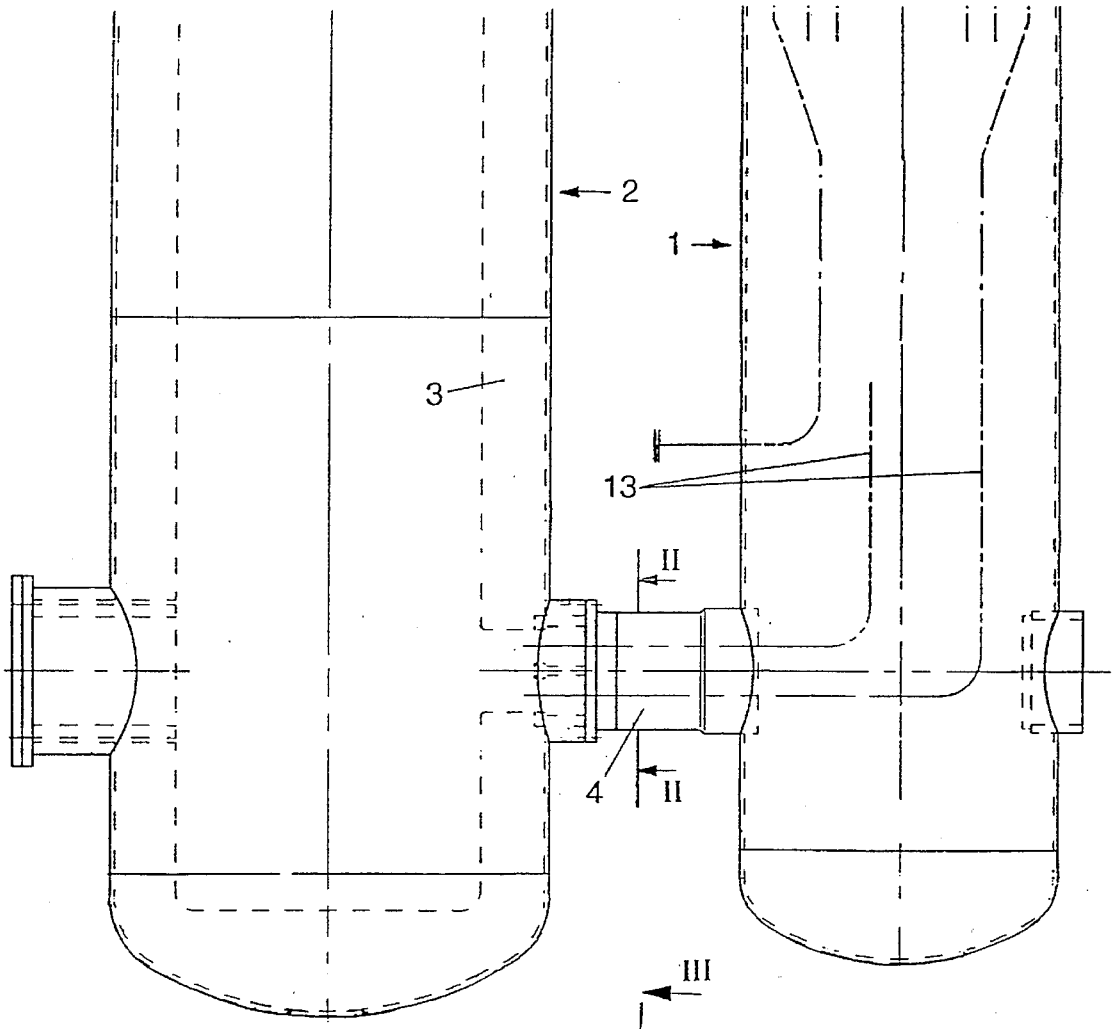
FIG. 1 is a view of a heat exchanger attached to a reactor.
Figure 2:
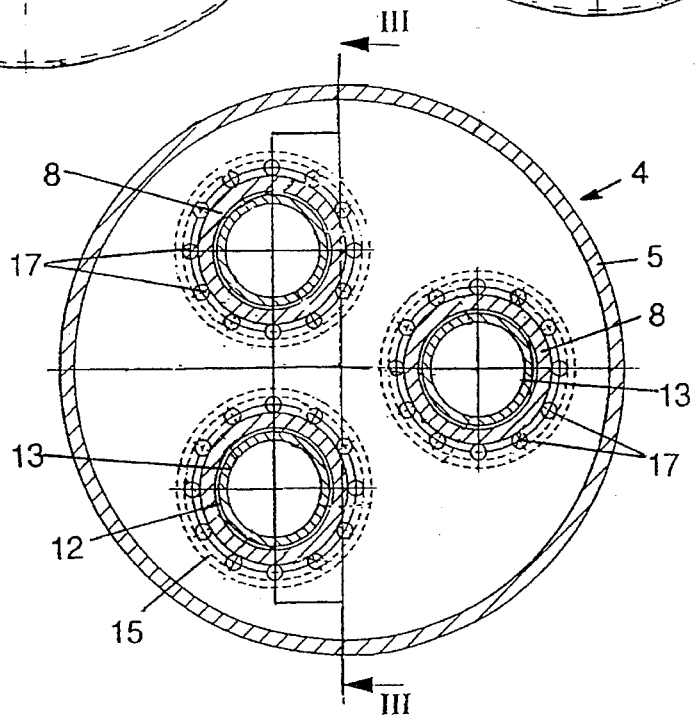
FIG. 2 is a section along the line II—II in FIG. 1.
Figure 3:
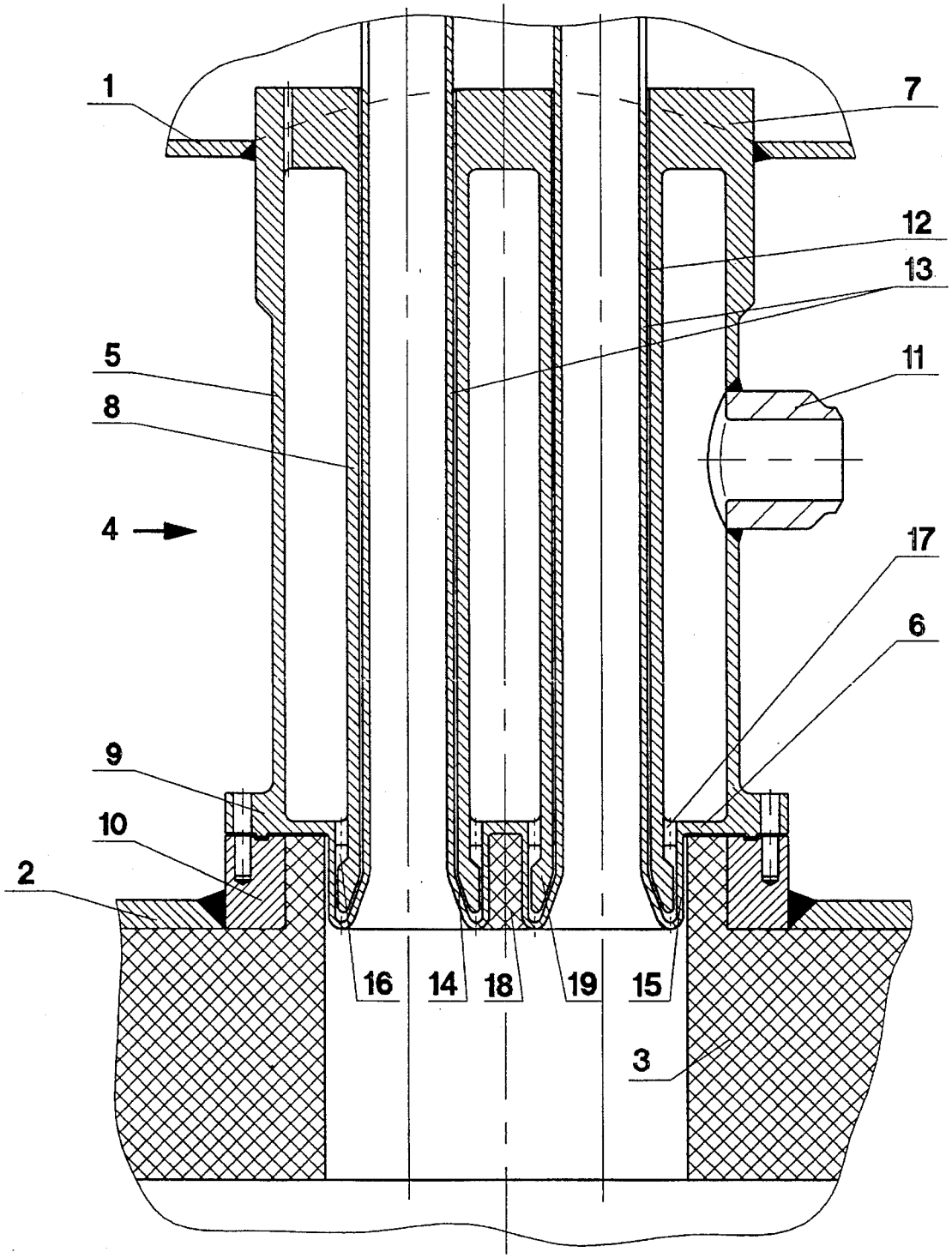
FIG. 3 is a section along the line III—III in FIG. 2.

A heat exchanger 1 is employed to cool hot gas, especially synthesis gas produced in a reactor 2. Reactor 2 is lined with a refractory lining 3 and communicates with the heat exchanger through a transitional section. The transitional section is a water compartment 4, and will now be specified.

Water compartment 4 has a jacket 5 demarcated at the gas-intake end by a thinner pipe slab 6 and at the gas-outlet end by a thicker pipe slab 7. Jacket 5 accommodates several, three in the present case, pipes 8. Pipes 8 are fastened gas-tight inside slabs 6 and 7. Pipes 8 accordingly act as anchors and, in conjunction with jacket 5, support thinner pipe slab 6 against thicker pipe slab 7.

Thinner pipe slab 6 is provided with a flange 9. Flange 9 is screwed to a thick-walled block 10. Thick-walled block 10 is welded into the wall of heat exchanger 1. There is an intake 11 for a coolant, compressed water for example, in jacket 5.

A gas pipe 13 extends loosely through each anchor pipe 8, leaving a cylindrical gap 12. Gas pipes 13 open into reactor 2. Adjacent to water compartment 4, they coil through heat exchanger 1 with their ends extend out of it.

Gas pipes 13 are elongated as they extend toward reactor 2 through thinner pipe slab 6. The elongated ends 14 of gas pipes 13 are reversed outside and extend back to thinner pipe slab 6. The sides of the reversed ends 15 that face reactor 2 are welded along a section concentric to anchor pipe 8 to thinner pipe slab 6. Elongated and reversed pipe ends 14 and 15 accordingly constitute a torus that in conjunction with part of thinner pipe slab 6 demarcates a space 16. Elongated and reversed pipe ends 14 and 15 can accordingly expand freely when gas pipe 13 is heated by the hot gas, preventing stress in the joint where gas pipes 13 connect to thinner pipe slab 6.

Bores 17 extend concentric with anchor pipes 8 through thinner pipe slab 6 inside the cylindrical surface between anchor pipe 8 and the reverse 15 on the end of gas pipe 13. Bores 17 connect the inside of water compartment 4 to the cylindrical gap 12 between pipes 8 and 13 by way of the space 16 demarcated by elongated and reversed pipe ends 14 and 15. Space 16 accordingly communicates with the coolant-circulating system, and elongated and reversed pipe ends 14 and 15 are cooled and protected from overheating. The flow of coolant in space 16 can be accelerated and the cooling action improved by extending anchor pipes 8 beyond thinner pipe slab 6 and into space 16. Inside space 16, the ends of anchor pipes 8 function as channels 19 for conveying the coolant.

Additional protection against overheating can be attained by embedding the elongated and reversed ends 14 and 15 of gas pipes 13 in heat-resistant ceramic 18.

Coolant is added to water compartment 4 through intakes 11, and leaves for heat exchanger 1 through the cylindrical gap 12 at the rear of the compartment. It cools the hot gas flowing through the coiled section of pipes 13. As the coolant heats up, it is extracted from the heat exchanger by a known procedure, and its heat exploited.

We claim:

1. A water compartment for a heat exchanger for cooling hot gases, comprising: a jacket and a thinner pipe slab resting on a thicker pipe slab by way of said jacket and anchor pipes, said anchor pipes being accommodated in said jacket and fastened to the slabs; gas pipes, extending through said anchor pipes and leaving a cylindrical space; said gas pipes being elongated and extending beyond said thinner pipe slab, elongated ends of said gas pipes being reversed outside; reversed ends of said gas pipes being fastened tight to said thinner pipe slab radially remote from said anchor pipes; and bores extending through an annular area of said thinner pipe slab between said reversed ends of said gas pipes and said anchor pipes.

2. A water compartment as defined in claim 1, wherein said elongated ends and said reversed ends of said gas pipes are embedded in a refractory ceramic.

3. A water compartment as defined in claim 1, wherein said anchor pipes are elongated and extend beyond said thinner pipe slab and into a space demarcated by said elongated ends and said reversed ends of said gas pipes, said gas pipes comprising channels for conveying coolant in said space.

4. A water compartment as defined in claim 1, wherein said thinner pipe slab is fastened to a block welded into a wall of a gasification reactor.

* * * * *